US006753276B2

(12) United States Patent
Warlick et al.

(10) Patent No.: US 6,753,276 B2
(45) Date of Patent: Jun. 22, 2004

(54) NONWOVEN FABRIC OF HYDRODYNAMICALLY ENTANGLED WASTE COTTON FIBERS

(75) Inventors: Anderson Warlick, Gastonia, NC (US); Quintin Shuler, Gastonia, NC (US)

(73) Assignee: Magnolia Manufacturing Company, Inc., Gastonia, NC (US)

( * ) Notice: Subject to any disclaimer, the term of this patent is extended or adjusted under 35 U.S.C. 154(b) by 130 days.

(21) Appl. No.: 10/041,353

(22) Filed: Jan. 8, 2002

(65) Prior Publication Data

US 2003/0127342 A1 Jul. 10, 2003

(51) Int. Cl.[7] ..... D04H 1/46

(52) U.S. Cl. ..... 442/408; 442/76; 442/79; 442/85; 442/86; 442/123; 442/131; 442/132; 442/133; 442/152; 442/357; 442/394; 442/402; 442/405; 442/406; 442/407; 442/409; 442/410

(58) Field of Search ..... 442/76, 79, 85, 442/86, 123, 131, 132, 133, 152, 357, 394, 402, 405, 406, 407, 408, 409, 410

(56) References Cited

U.S. PATENT DOCUMENTS

| | | | | |
|---|---|---|---|---|
| 2,971,643 A | | 2/1961 | Farley | 206/83.5 |
| 3,331,222 A | | 7/1967 | Marks | 66/202 |
| 3,485,706 A | | 12/1969 | Evans | 161/72 |
| 3,647,061 A | | 3/1972 | Kaupin | 206/83.5 |
| 3,674,139 A | | 7/1972 | Manasian et al. | 206/83.5 |
| 4,071,138 A | | 1/1978 | Wright | 206/83.5 |
| 5,104,703 A | | 4/1992 | Rachman et al. | 428/35.6 |
| 5,215,191 A | | 6/1993 | Wright | 206/83.5 |
| 5,380,582 A | | 1/1995 | Neely, Jr. et al. | 428/220 |
| 5,397,612 A | | 3/1995 | Small et al. | 428/36.1 |
| 5,761,778 A | | 6/1998 | Fleissner | 28/104 |
| 5,960,525 A | * | 10/1999 | Fleissner | 28/104 |
| 6,055,710 A | | 5/2000 | Fleissner | 28/104 |

* cited by examiner

*Primary Examiner*—Arti R. Sinah
(74) *Attorney, Agent, or Firm*—Kennedy Covington Lobdell & Hickman, LLP

(57) ABSTRACT

A nonwoven fabric includes a cohesively integrated web of hydrodynamically entangled short-staple or "waste cotton" fibers. A batt of waste cotton fibers is hydrodynamically needled by high-pressure streams of water. The hydrodynamic energy of the streams causes the fibers to cohere and to become mutually entangled, which in turn results in a fabric of sufficient strength to be used for, among other things, a bag for a bulk material and particularly a bag or cover for a cotton bale.

1 Claim, 4 Drawing Sheets

NONWOVEN FABRIC OF HYDRODYNAMICALLY ENTANGLED WASTE COTTON FIBERS

FIELD OF THE PRESENT INVENTION

The present invention relates generally to nonwoven, natural-fiber fabrics, and specifically to a nonwoven fabric of hydrodynamically entangled waste cotton fibers, which fabric is suited to form, among other things, bags for containing cotton bales.

BACKGROUND OF THE PRESENT INVENTION

Cotton fiber, a so-called "natural fiber" because it is taken from a plant instead of from a synthetic source such as petrochemicals, is widely used in making fabrics of various types. Before cotton can be used as a fabric, it must undergo a series of processing steps. The cotton plant produces bolls of raw cotton, which are typically mechanically harvested and delivered to a gin, where foreign material such as dirt, plant matter, and insect parts are removed, and where the fiber is separated from the seeds embedded within it.

The cotton fiber then undergoes successive processes, such as picking and combing, to clean the fiber further and to cause the individual fibers to begin to cohere, or align. Picked cotton fiber destined to become yarn for weaving or knitting is then laid down into a lap. Carding further refines the cotton fiber and begins the process of removing short-staple fibers, which are considered to be too short to be commercially useful in a yarn. Longer fibers generally provide greater resistance to breaking (in a yarn) or tearing (in a woven or knitted fabric). Short-staple, or "waste cotton," fibers have typically been regarded as not usable in yams and fabrics, and so have been used only for their absorptive capabilities, rather than for their tensile strength, in disposable products such as diapers, sanitary napkins, cigarette filters, and the like.

Because ginned cotton is fairly lightweight, it is useful to compress it into bales of a convenient size for transportation. Once cotton has been compressed, however, it is necessary to hold it in a compressed condition. Historically, this was accomplished by placing bands around the bale and wrapping the bale in burlap or in a woven or knitted fabric. A more modern method is to wrap the bale in polyethylene film or in woven polypropylene, typically in a bag form, after banding. Wrapping the bale also keeps dirt and foreign matter from contaminating the ginned cotton. Though covering the bale is a necessary step, these coverings create an additional expense for the cotton processor. Consequently, it is desirable to use a material that may be obtained inexpensively, in order to reduce processing costs.

SUMMARY OF THE PRESENT INVENTION

Briefly summarized, the present invention provides for a non-woven fabric comprises hydrodynamically entangled waste cotton fibers to form a binderless integrated web. Hydrodynamic entanglement, also known as hydroentanglement or hydroneedling, is a process that is well known in the art of textile manufacturing. Hydrodynamic entanglement is usually accomplished by feeding a thick batt of fibers through a series of fine jets of water at water pressures ranging from 10 to 600 bar or more. Energy transferred from the jets of water serves to compact or punch down the batt of fibers, to cause the fibers to cohere, and to entangle the fibers. Often, and especially in the case of natural fibers, a thermoplastic material is intermixed with the fibers to enable them to be thermally bonded, thereby increasing the strength of the fabric. The end result is a non-woven fabric of a fairly uniform density and strength. Hydrodynamic entanglement is typically used to entangle so-called "endless" fibers—for instance, synthetic fibers that are extruded from molten plastic and have a far greater fiber length than natural fibers. One common use for hydroentangled fiber fabrics is for surgical gowns and drapes; because of the relatively inexpensive manufacturing process, such fabrics are disposable and thus ideal for such "single-use" applications.

Although hydrodynamic entanglement is well known for synthetic fibers and usable for long-staple natural fibers, heretofore the process has not been used to process waste cotton fibers into usable fabric, nor has the process been thought to be capable of effectively forming usable fabric from waste cotton fibers. An object of the present invention is, therefore, to provide for a fabric comprising waste cotton fibers that have been hydrodynamically entangled. As used herein, the term "waste cotton fibers" is intended to mean cotton fibers predominantly of a staple fiber length less than about 1⅛ inches, which are primarily unsuitable for spinning into a usable yarn, although longer fibers may be used without departing from the scope of the invention.

It is another object of the present invention to provide for a fabric that does not require a thermoplastic bonding agent in order to form an integrated web of waste cotton fibers, because of the expense associated with providing and interspersing such an agent within the batt.

It is still another object of the present invention to provide for a bag, suitable for containing and protecting a bulk material—such as ginned and baled cotton—which is formed from fabric comprising a binderless cohesively integrated web of hydrodynamically entangled waste cotton fibers, and which may be provided at a substantially smaller cost than traditional bags.

It is a further object of the present invention to provide for the combination of a cotton bale and a cover for the bale, the cover comprising a fabric that includes a cohesively integrated web of hydrodynamically entangled waste cotton fibers.

BRIEF DESCRIPTION OF THE DRAWINGS

Further features, embodiments, and advantages of the present invention will become apparent from the following detailed description with reference to the drawings, wherein.

DETAILED DESCRIPTION OF PREFERRED EMBODIMENTS

Figure 1:
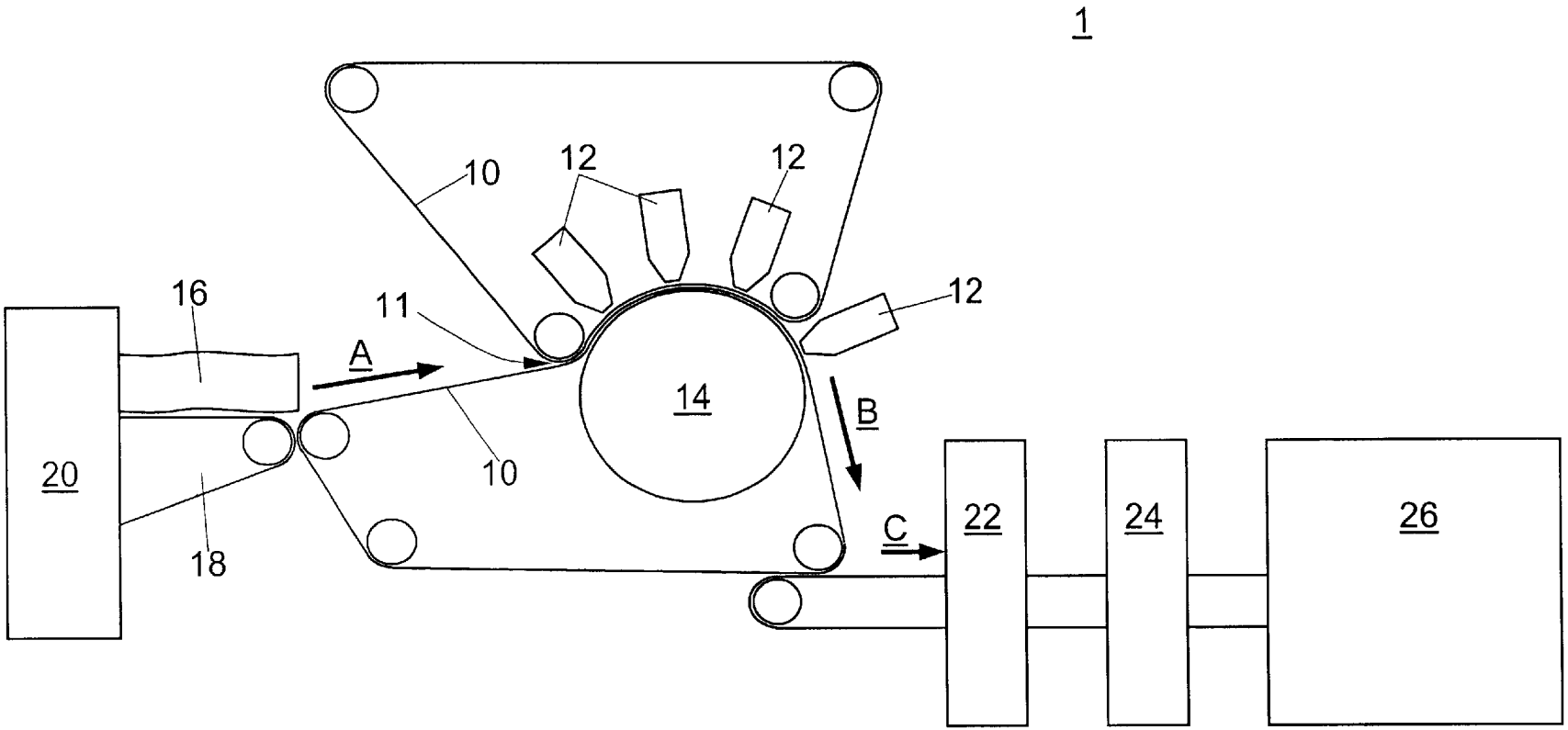
FIG. 1 is a schematic representation of a hydrodynamic needling machine and waste cotton being processed thereon.

Referring now to FIG. 1, a hydrodynamic needling machine 1 (also known as a hydrodynamic entanglement machine) is schematically depicted. Hydrodynamic needling machines are well known in the art of textile manufacturing. One such machine is manufactured by Fleissner GmbH & Co. Maschinenfabrik of Egelsbach, Germany, under the trademark AQUAJET, and Fleissner, U.S. Pat. No. 5,960, 525, issued Oct. 5, 1999, teaches such a device.

The hydrodynamic needling machine 1 generally comprises a pair of porous conveyor belts 10, a plurality of water jets 12, and one or more perforated needling drums 14. A non-integrated batt of waste cotton fibers 16, varying in thickness between ⅛" and 5", depending on the desired thickness of the resulting fabric, is fed from a conveyor 18 of line 20, which may be a carding line or an air-laying line, and onto lower conveyor belt 10. Batt 16 is conveyed in the direction of arrow A to a hydroneedling stage and held between the two conveyor belts 10, at 11, which belts serve to advance the fabric through the hydroneedling stage without stretching the web. It may be desirable to wet the batt before the hydroneedling stage to reduce the loft of the batt, particularly for batts of higher loft.

At the hydroneedling stage, batt 16, having been compressed somewhat between the two conveyor belts 10, is held against needling drum 14 and subjected to a plurality of pressurized water jets 12. Water from the jets 12 traverses porous upper conveyor belt 10, impinges upon batt 16, traverses porous lower conveyor belt 10, and is drawn off through perforations in needling drum 14. As water passes under pressure through batt 16, hydrodynamic energy transforms batt 16 in at least two ways. First, batt 16 is further compressed to a degree in accordance with the water pressure. Second, the individual fibers of batt 16 are made to cohere (mutually align) by entanglement with each other. Because of the regularized and coherent application of hydrodynamic energy to batt 16, the resulting coherently integrated web is of substantially uniform thickness, texture, and strength, making it suitable for use as a fabric. After hydroneedling, batt 16 is conveyed in the direction of arrow B to a finishing stage.

Because cotton is a highly absorptive material, a portion of the water used during hydrodynamic entanglement is absorbed within the cotton. Therefore, following the hydroneedling process, it is helpful to extract a portion of the water from the web in order to speed drying. Batt 16, now a fabric, is carried in the direction of arrow C through water extraction zone 22. After the excess water has been extracted, the fabric may be conveyed through an optional treatment zone 24, for instance, for adding a waterproofing chemical or a UV inhibitor to the fabric. Following optional zone 24, the fabric enters drying zone 26, where the fabric is dried to the necessary extent. Following drying, the fabric may be conveniently wound onto rolls for a subsequent sewing operation, according to manufacturing needs.

Figure 2A:
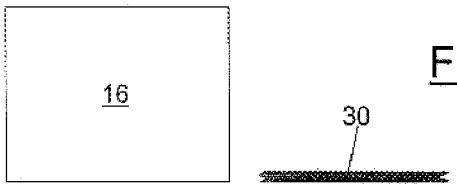
FIG. 2A is a partially schematic side view of a batt of waste cotton fibers, pre- and post-entanglement.
Figure 2B:
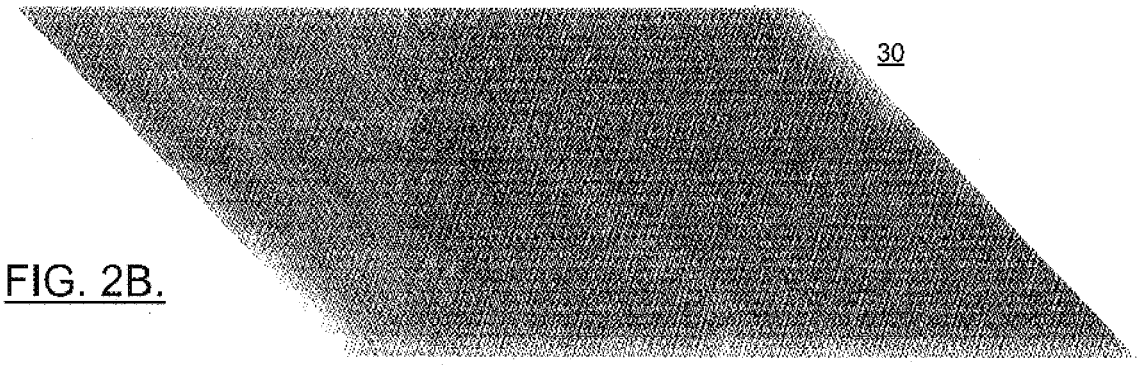
FIG. 2B is a large-scale schematic perspective view of a cohesively integrated web of hydrodynamically entangled waste cotton fibers.

Referring now to FIGS. 2A–2B, fabric 30 is shown in comparison to batt 16. In FIG. 2A, batt 16, in its pre-hydroneedling state, is schematically depicted in a side view, and fabric 30, in a post-hydroneedling state, is depicted in a partial side view, in order to demonstrate both that the hydroneedling process works to compress batt 16 to a great degree and that the resulting fabric 30 comprises fibers that are mutually coherent and entangled (as can be seen from the pattern). Those skilled in the art will recognize that FIG. 2A does not illustrate any particular scale, as various thicknesses of batt 16 can produce a variety of thicknesses of fabric 30, depending upon the water pressure applied during hydroneedling.

In FIG. 2B, a fabric 30 comprising a cohesively integrated web of hydrodynamically entangled waste cotton fiber is depicted in a large scale schematic perspective view. As can be seen from the figure, the waste cotton fibers have been entangled to form within fabric 30 a substantially uniform and regularized web pattern. Because the fibers have been entangled to a degree that is commensurate with their length, the resulting fabric is sufficiently strong and resilient to allow it to serve as a bag or a cover for a bulk material, such as a cotton bale, even if that bulk material is in a compressed state and is susceptible of some expansion against the resistance of the bag or cover.

Figure 2C:
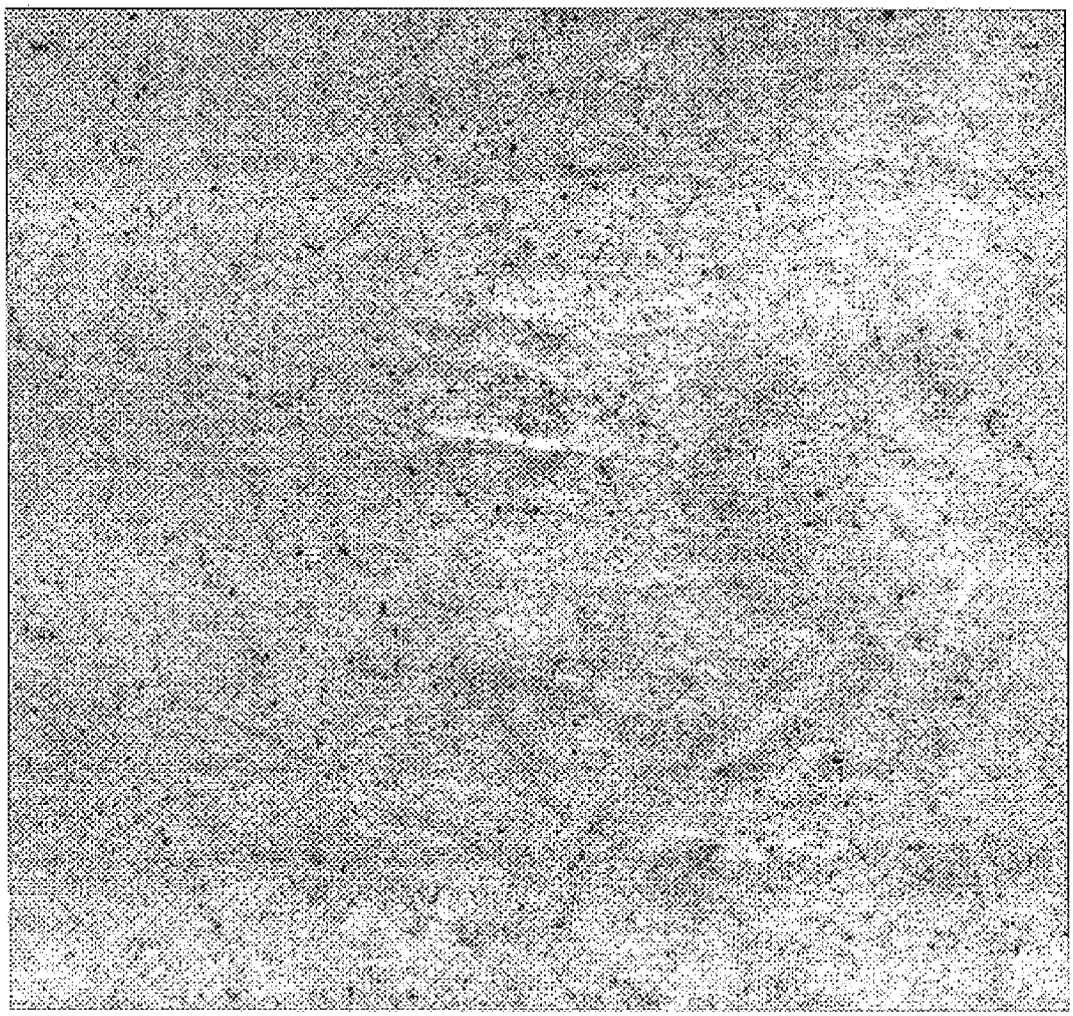
FIG. 2C is a photograph of a web as in FIG. 2B.

FIG. 2C is a photograph of a fabric as represented in FIG. 2B. The flecks visible in the photograph constitute foreign matter, which may comprise dirt, insect matter, plant matter, or other non-fiber matter, and which need not be fully removed prior to processing of the waste cotton fibers to form the fabric of the present invention.

Figure 4:
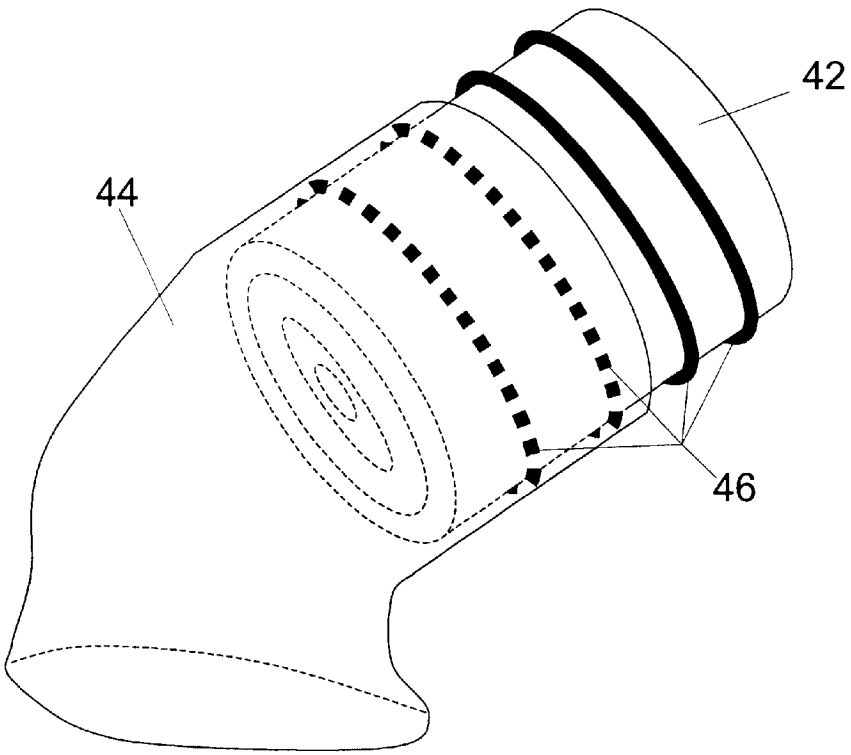
FIG. 4 depicts a cotton bale and cover for the bale.
Figure 3:
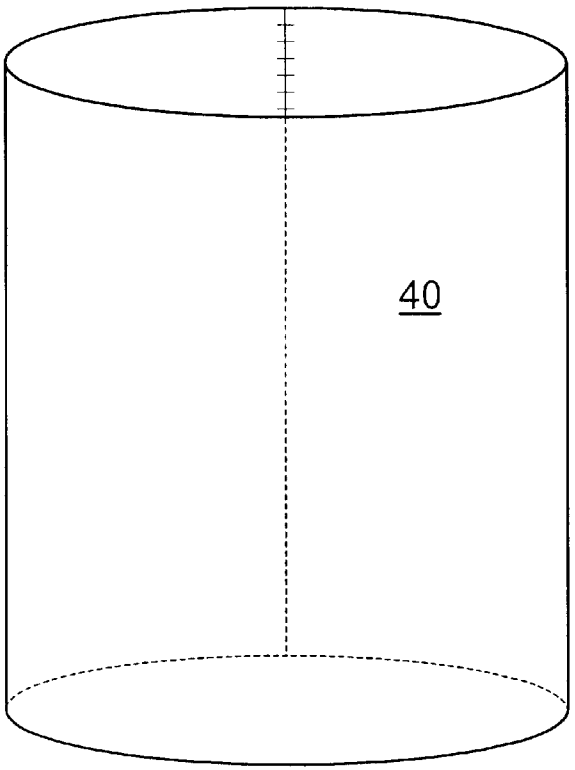
FIG. 3 depicts a bag and a bulk material in combination.

FIGS. 3 and 4 depict two possible useful configurations for the fabric as described above and as depicted in FIGS. 2A–2B. FIG. 3 depicts a bag 40 for a bulk material, such as cotton (not shown). FIG. 4 depicts a cotton bale 42 and a cover 44 for the bale, which cover 44 comprises a hydrodynamically entangled fabric according to the present invention. Compression bands 46 provide protection against undesired decompression. Because baled cotton has undergone an extensive and expensive ginning operation to remove non-fibrous matter from the cotton fiber, it is likewise desirable to maintain bale 42 in a substantially clean state, which purpose is served by the cover 44 of the present invention. Cover 44 may also serve to contain the bale if some of compression bands 46 break.

Although simple applications are depicted in FIGS. 3 and 4, those persons skilled in the art to which the present invention pertains will recognize that a wide variety of configurations is possible, and that the uses of the fabric of the present invention are not limited to bagging or covering applications or to any particular configuration of the fabric.

Those skilled in the art of manufacturing fabrics will also recognize that fabrics of differing weights, textures, and strengths are desirable for different applications, and further that the fabric of the present invention may be manufactured according to desired characteristics dependent upon the particular application, by altering the parameters of manufacture. Indeed, the interplay between different manufacturing parameters results in particular characteristics of the finished fabric. The thickness of the fabric may be adjusted by adjusting the loft or, correspondingly, the weight of the entering batt, while maintaining water pressure at a chosen level. The strength of the fabric may be adjusted by adjusting the loft or weight of the entering batt and by adjusting the water pressure, or by utilizing a drum of a different perforation configuration to adjust the level of entanglement. The width of the entering batt determines the width of the resulting fabric, and the texture of the resulting fabric is generally dependent upon the drum configuration. Although a wide range of variations is possible, these various embodiments are nevertheless well within the scope of the present invention because they share a common core internal structure: they are cohesively integrated webs of hydrodynamically entangled waste cotton fibers.

The typical operating ranges for manufacturing the fabric of the present invention are as follows, although these or other methods of manufacturing the fabric of the present invention may permit or even require values outside of these ranges without departing from the scope of the present invention. Therefore, these values are intended to be illustrative rather than limiting. The loft of the entering batt generally varies between ⅛" and 5", with a batt weight of between 50 g/m$^2$ and 200 g/m$^2$. Generally, a minimum of 2 water injectors is required, although present machinery allows for as many as 14 injectors and there is, theoretically, no upper limit on the number of injectors. Water pressures of up to 600 bar are available with present machinery, although higher pressures might be achievable and useful for particular applications; the selected water pressure is highly dependent upon the weight of the material being processed, since a major component of the manufacturing process is the compaction of the entering batt.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof.

What is claimed is:

1. A nonwoven fabric consisting essentially of a cohesively integrated binderless web consisting of;

hydrodynamically entangled waste cotton fibers;

and a substantial quantity of foreign matter left after an initial process of cleaning wherein said fibers are predominantly of a staple length unsuitable for spinning into a yarn or fiber.

* * * * *